US005426829A

United States Patent [19]

Hsiung

[11] Patent Number: 5,426,829

[45] Date of Patent: Jun. 27, 1995

[54] PACKING STRAP FASTENER

[76] Inventor: Bear Hsiung, 5F, No. 30, Lane 179 Sec. 2, Nei Hu Rd., Taipei, Taiwan

[21] Appl. No.: 266,257

[22] Filed: Jun. 27, 1994

[51] Int. Cl.[6] ..... A44B 11/00

[52] U.S. Cl. ..... 24/197; 24/193; 24/196; 24/200; 24/16 R

[58] Field of Search ..... 24/197, 196, 198, 200, 24/16 R, 68 CD, 193, 17 AP, 17 B; 403/211

[56] References Cited

U.S. PATENT DOCUMENTS 3,121,270 2/1964 Van Den Broek et al. ..... 24/197
3,414,943 12/1968 Hattori ..... 24/16 R
3,967,347 7/1976 Bickis, Sr. ..... 24/193
4,117,573 10/1978 Nakamura ..... 24/200

*Primary Examiner*—Victor N. Sakran
*Attorney, Agent, or Firm*—Browdy and Neimark

[57] ABSTRACT

A packing strap fastener including a looped locating plate having a trapezoidal block in the middle of the front end thereof, a packing strap having two opposite ends turned backwards to form two loops respectively inserted into the center opening of the looped locating plate, and a key having two parallel key blades respectively inserted through the loops thus formed at the two opposite ends of the packing strap permitting the trapezoidal block of the looped locating plate to be firmly retained between the tips of the key blades.

1 Claim, 3 Drawing Sheets

PACKING STRAP FASTENER

BACKGROUND OF THE INVENTION

The present invention relates to a packing strap fastener for joining the ends of a packing strap which can be conveniently unfastened for a repeated use.

When a product is packed in a packing box, the packing box is then sealed by an adhesive tape or packed by a packing strap through a packing machine. When a packing strap is used to pack a packing box through a packing machine, the two opposite ends of the packing strap is joined by a metal loop. During the packing process, the two opposite ends of the packing strap are inserted through the metal loop in the reversed directions and then stretched, and the metal loop is then gripped to deform causing the two opposite ends of the packing strap joined together. After packing, the packing box cannot be opened without breaking the packing strap. When the packing strap is broken, it cannot be used again and have to be thrown away. If the broken packing strap is not properly disposed of, it will causes an environmental pollution problem.

SUMMARY OF THE INVENTION

The present invention has been accomplished under the circumstances in view. It is therefore one object of the present invention to provide a packing strap fastener which is specifically designed for joining the ends of a packing strap. It is another object of the present invention to provide a packing strap fastener which can be conveniently fastened to join the ends of a packing strap manually. It is still another object of the present invention to provide a packing strap fastener which can be conveniently unfastened from the packing strap for a repeated use. It is still another object of the present invention to provide a belt fastener which does not damage the packing strap when unfastened.

According to the present invention, the packing strap fastener comprises a looped locating plate having a trapezoidal block in the middle of the front end thereof, a packing strap having two opposite ends turned backwards to form two loops respectively inserted into the center opening of the looped locating plate, and a key having two parallel key blades respectively inserted through the loops thus formed at the two opposite ends of the packing strap permitting the trapezoidal block of the looped locating plate to be firmly retained between the tips of the key blades. The packing strap fastener is unfastened from the packing strap by pulling the key outwards to release the key blades from the packing strap and the trapezoidal block of the looped locating plate. Therefore, the packing strap fastener as well as the packing strap are maintained intact when unfastened.

DETAILED DESCRIPTION OF THE PREFERRED EMBODIMENT

Figure 1:
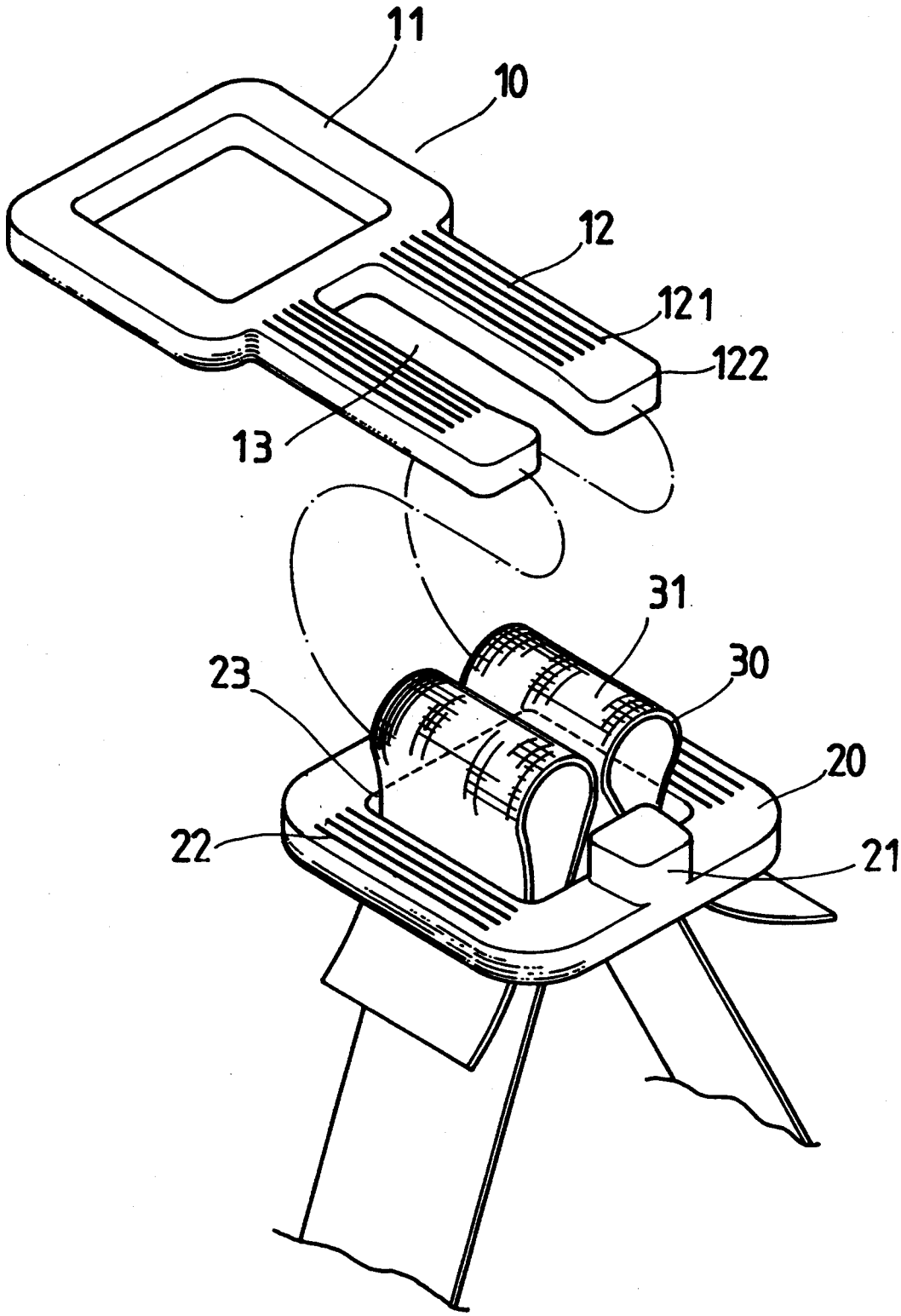
FIG. 1 is an exploded view of a packing strap fastener according to the present invention.

Referring to FIG. 1, a packing strap fastener in accordance with the present invention is generally comprised of a key 10 and a looped locating plate 20. The key 10 comprises a loop-like handle 11 and two parallel key blades 12 extended from the loop-like handle 11 in the same direction and spaced from each other by a gap 13. Each key blade 12 has a plurality of anti-skid ribs 121 on both sides and is terminating in a trapezoidal block 122. The looped locating plate 20 defines a center opening 23, having a trapezoidal block 21 in the middle of the front end thereof at the top and a plurality of anti-skid ribs 22 bilaterally disposed at the top.

Figure 2:
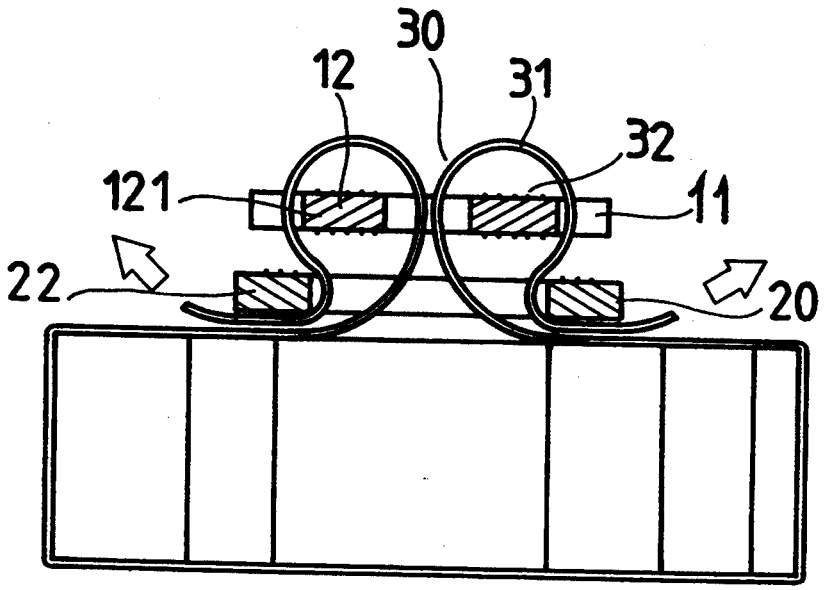
FIG. 2 is an installed view in section of the present invention, showing the the key blades of the key inserted through the loops formed at the two opposite ends of the packing strap.
Figure 3:
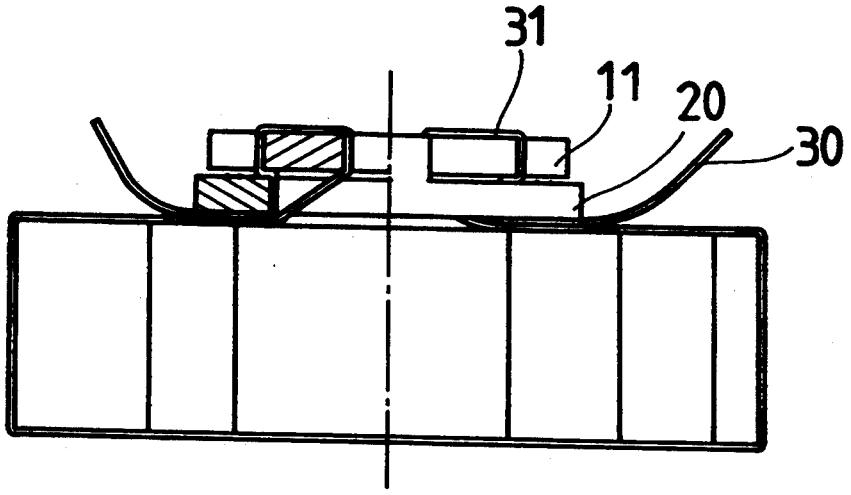
FIG. 3 is similar to FIG. 2 but showing the two opposite ends of the packing strap stretched and joined by the packing strap fastener.

Referring to FIGS. 2 and 3 and FIG. 1 again, when the packing packing strap 30 is wound round the packing box to be packed, the two opposite ends of the packing packing strap-30 are respectively turned outwards to form two loops 31, then the loops 31 are respectively inserted into the center opening 23 of the looped locating plate 20 (see FIG. 1), and then the key blades 12 of the key 10 are respectively inserted into the holes 32 defined within the loops 31 permitting the trapezoidal block 21 of the looped locating plate 20 to be engaged in the gap 13 between the trapezoidal blocks 122 of the key blades 12 of the key 12 (see FIG. 2), and then the two opposite ends of the packing packing strap 30 are respectively pulled outwards and stretched tight (see FIG. 3).

Figure 4:
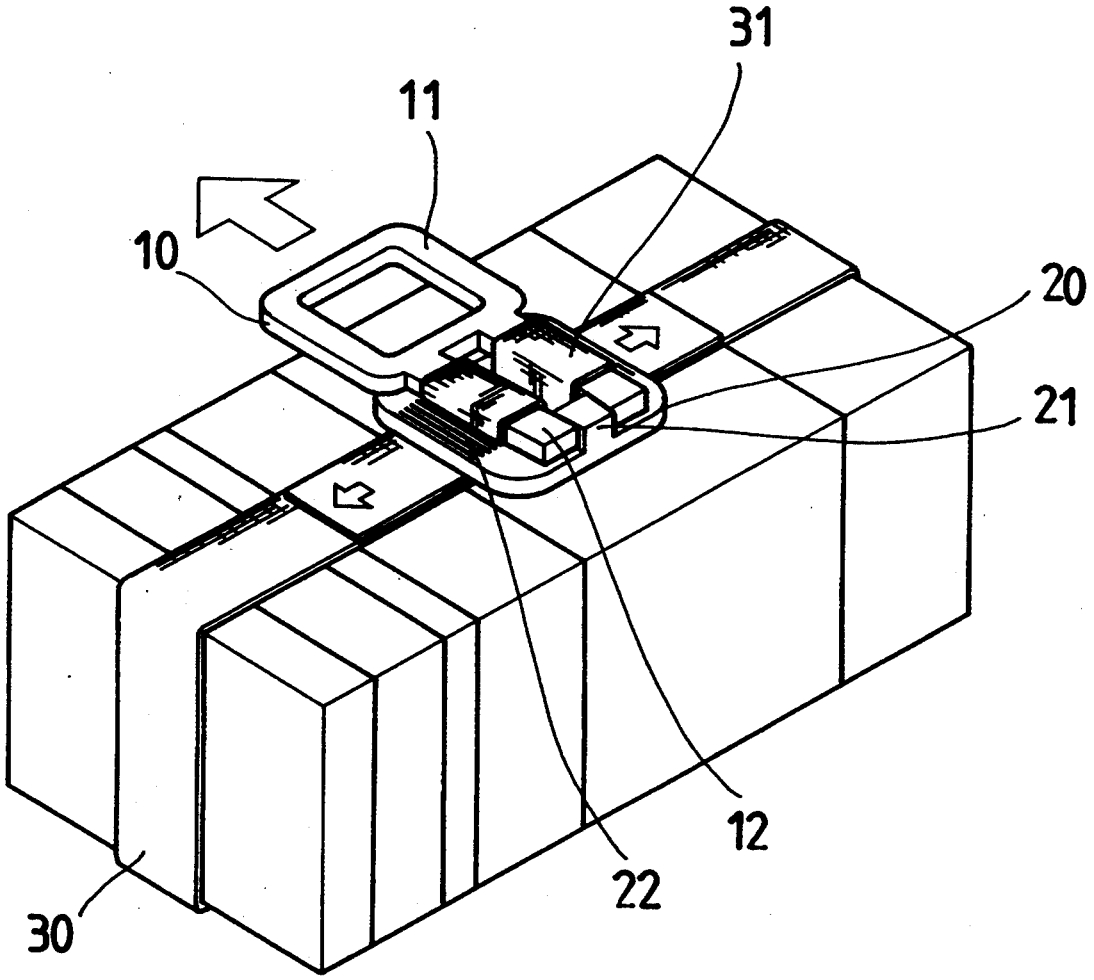
FIG. 4 is an elevational view showing the pulling direction of the key in unfastening the packing strap fastener.

Referring to FIG. 4, unfastening the packing strap fastener is easy and done by pulling the key 10 to release the key blades 12 from the trapezoidal block 21 of the looped locating plate 20. When unfastened, the packing strap fastener can be received for further use.

While only one embodiment of the present invention has been shown and described, it will be understood that various modifications and changes could be made without departing from the spirit and scope of the invention.

What is claimed is:

1. A packing strap fastener comprising a looped locating plate, and a key fastened to said looped locating plate to join the two opposite ends of a packing strap, wherein said looped locating plate comprises a center opening, into which the two opposite ends of the packing strap which are turned backwards to form a respective loop are inserted, a trapezoidal block in the middle of a front end thereof, and a plurality of anti-skid ribs bilaterally disposed at the top; said key comprises a loop-like handle and two parallel key blades respectively terminating in a respective trapezoidal block, said key blades having each a plurality of anti-skid ribs on both sides, and being respectively inserted through the loops thus formed by the two opposite ends of the packing strap, permitting the trapezoidal block of said looped locating plate to be retained between the trapezoidal blocks of said key blades.

* * * * *